United States Patent [19]

Finn et al.

[11] Patent Number: 4,610,569

[45] Date of Patent: Sep. 9, 1986

[54] HYBRID OFFSHORE STRUCTURE

[75] Inventors: Lyle D. Finn; Leo D. Maus, both of Houston, Tex.

[73] Assignee: Exxon Production Research Co., Houston, Tex.

[21] Appl. No.: 635,942

[22] Filed: Jul. 30, 1984

[51] Int. Cl.[4] ..... E02B 17/00; E02D 5/00

[52] U.S. Cl. ..... 405/202; 405/207; 405/227

[58] Field of Search ..... 405/195, 202–208, 405/210, 224, 227; 114/230, 264, 265, 293; 175/7

[56] References Cited

U.S. PATENT DOCUMENTS

| | | | |
|---|---|---|---|
| 3,145,538 | 8/1964 | Young | 405/224 X |
| 3,522,709 | 8/1970 | Vilain | 61/46.5 |
| 3,524,323 | 2/1969 | Miller | 61/46.5 |
| 3,553,969 | 1/1971 | Chamberlin et al. | 61/46 |
| 3,626,701 | 12/1971 | Laffont | 61/46.5 |
| 3,636,716 | 1/1972 | Castellanos | 61/46.5 |
| 3,667,240 | 6/1972 | Vilain | 405/210 X |
| 3,670,515 | 6/1972 | Lloyd | 61/46.5 |
| 3,735,597 | 5/1973 | Guy | 61/46.5 |
| 3,766,582 | 10/1973 | Lloyd et al. | 405/202 O |
| 3,768,268 | 10/1973 | Laffont et al. | 61/46.5 |
| 3,903,705 | 9/1975 | Beck et al. | 61/46 |
| 3,961,489 | 6/1976 | Mo | 405/207 O |
| 4,212,561 | 7/1980 | Wipkink | 405/195 |
| 4,214,843 | 7/1980 | Rohde | 405/203 X |
| 4,231,682 | 11/1980 | Tuson | 405/202 |
| 4,273,470 | 6/1981 | Blomsma et al. | 405/202 |
| 4,363,568 | 12/1982 | Schuh | 405/227 O |
| 4,378,179 | 3/1983 | Hasle | 405/227 |
| 4,417,831 | 11/1983 | Abbott et al. | 405/227 |

FOREIGN PATENT DOCUMENTS

| | | |
|---|---|---|
| 2066336A | 7/1981 | United Kingdom . |
| 2123883A | 2/1984 | United Kingdom . |

OTHER PUBLICATIONS

Finn, L. D., "A New Deep-Water Platform-The Guyed Tower", Journal of Petroleum Technology, Apr. 1978, pp. 537–544 (First Presented at the 8th Annual Offshore Technology Conference Held in Houston, TX, May 3–6, 1976, OTC Paper No. 2688).

Maus, L. D., Finn, L. D., and Turner, J. W., "Development of the Guyed Tower: A Case History", SPE Paper No. 11998, Presented at the 58th Annual Technical Conference and Exhibition Held in San Francisco, CA, Oct. 5–8, 1983.

*Primary Examiner*—Thomas F. Callaghan
*Assistant Examiner*—Nancy J. Stodola
*Attorney, Agent, or Firm*—Keith A. Bell

[57] ABSTRACT

A hybrid offshore structure for conducting petroleum drilling and producing operations in very deep waters is disclosed. The structure consists primarily of a substantially rigid lower section extending upwardly from the bottom of the body of water to a pivot point located intermediate the bottom and the surface of the body of water, a compliant upper section extending upwardly from the pivot point to a deck located above the water surface, pivot means located proximate the pivot point and adapted to permit the compliant upper section to pivot laterally in response to environmental loads, and torsion means adapted to transmit torsional loads from the compliant upper section to the substantially rigid lower section. The lower section may comprise either a conventional trussed steel frame fixed to the bottom of the body of water by a plurality of piles or a concrete or steel gravity base. The compliant upper section may optionally be either a guyed tower or a buoyant tower. A variety of suitable pivot means and torsion means may be used. The pivot point is positioned so that the weight of the hybrid structure is substantially minimized while maintaining the flexural vibration period of the structure within acceptable limits. Generally, the pivot point will be located above the bottom of the body of water a distance of between about 10 percent and about 50 percent of the total depth of the body of water.

19 Claims, 7 Drawing Figures

FIG. 1
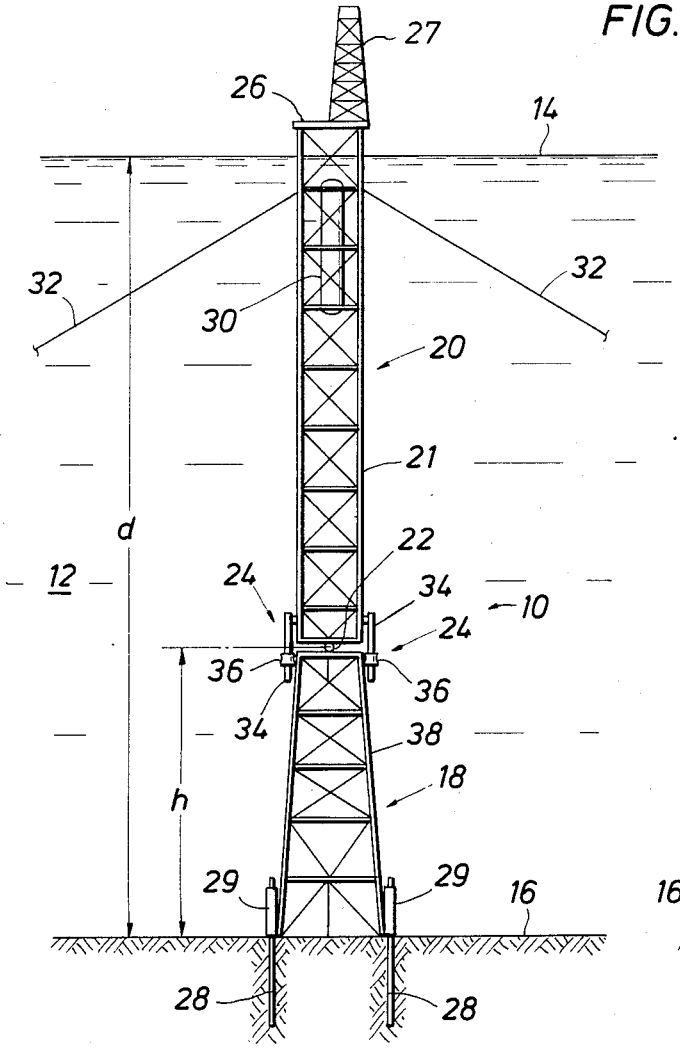
FIG. 2
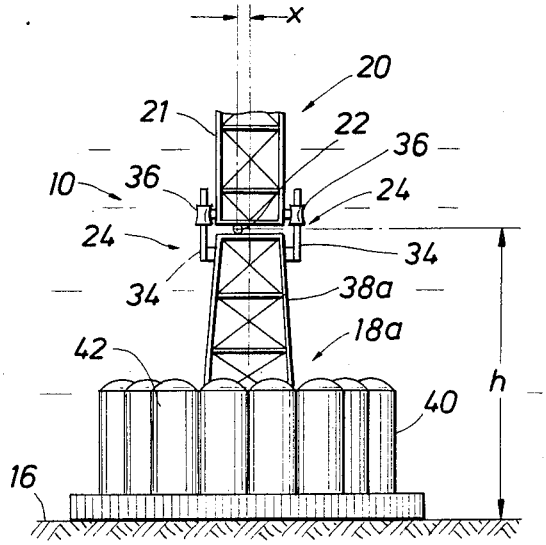
FIG. 4
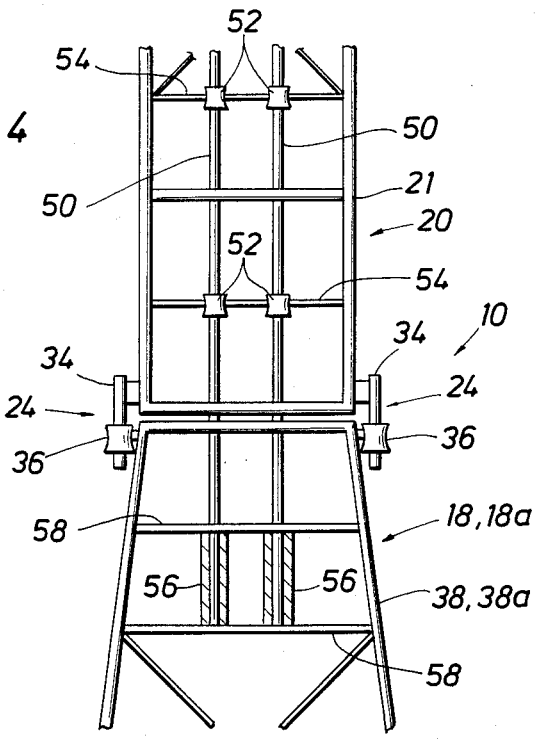
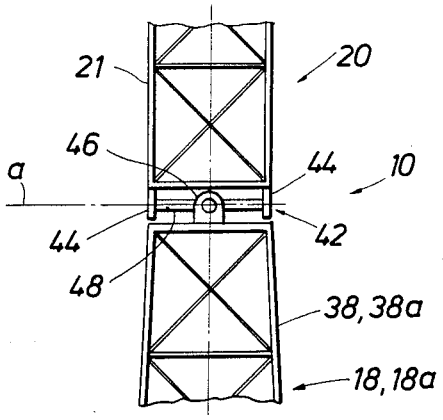
FIG. 3

HYBRID OFFSHORE STRUCTURE

FIELD OF THE INVENTION

This invention relates to an articulated offshore structure for use in conducting offshore operations such as, for example, offshore petroleum drilling and producing operations. More particularly, the invention pertains to a hybrid offshore structure for use in conducting such operations in very deep waters.

BACKGROUND OF THE INVENTION

Since its beginnings in the late 1940's, the offshore petroleum industry has been steadily moving into progressively deeper waters. Until recently, offshore petroleum drilling and producing operations typically have been conducted from rigid, bottom-founded offshore structures such as conventional steel jacket structures or concrete or steel gravity structures. However, as described below, water depths of interest to the offshore petroleum industry have now increased to the point where such rigid, bottom-founded structures are no longer technically or economically feasible.

An offshore structure must be designed to withstand not only the relatively infrequent impacts of very large waves caused by severe storms, but also the cumulative effect of repeated impacts of smaller waves which are present under most sea states. These smaller waves are typically random in nature. However, it has been found that the wave periods of these smaller waves generally fall between about 6 seconds and about 20 seconds. Such waves are likely to contain significant amounts of energy.

When a wave impacts on an offshore structure, it causes a dynamic flexural vibration in the structure generally known as a wave dynamic response. If the flexural vibration period of the structure falls within the range of wave periods likely to contain significant amounts of energy, (i.e., 6 seconds to 20 seconds), the structure will resonate under certain conditions. Resonance of the structure is likely to impose excessive forces on the structure and may result in fatigue damage. Accordingly, offshore structures are designed so that the flexural vibration period of the structure falls outside the range of wave periods likely to contain significant amounts of energy. Rigid, bottom-founded structures are typically designed so that the flexural vibration period of the structure is less than about 6 or 7 seconds, depending on the location of the structure.

The wave dynamic response of a rigid, bottom-founded structure may be characterized as a lateral vibration of a beam having one end fixed and the other end free. Accordingly, for a structure having a given flexural stiffness and a given distribution of weight along its length, the flexural vibration period of the structure is proportional to the height of the structure (depth of the water) squared. Therefore, as water depth increases, the flexural stiffness of a rigid, bottom-founded structure must be increased so as to maintain the flexural vibration period within acceptable limits.

The design of a rigid, bottom-founded structure begins to be dominated by wave dynamic response in water depths of about 800 to 1,000 feet. Past experience has shown that once wave dynamic response begins to dominate the design, the structural steel tonnage, and hence the cost, required to maintain the flexural vibration period of the structure within acceptable limits increases very rapidly. Beyond a water depth of about 1,000 feet, the steel tonnage and associated costs for a rigid, bottom-founded structure increase so rapidly that an economic limit is soon reached, even given the most favorable economic conditions.

The problem outlined above has resulted in the development of new types of offshore structures generally known as "compliant towers". Compliant towers are bottom-founded structures that do not rigidly resist environmental forces. Rather, a compliant tower is designed to yield to the environment in a controlled manner. Basically, the tower is allowed to oscillate a few degrees from vertical in response to the applied force. This oscillation creates an inertial restoring force which opposes the applied force.

One such compliant tower is the "guyed tower". Basically, a guyed tower is a trussed frame of generally uniform cross-section that extends from the bottom of the body of water upwardly to a deck supported above the water surface. The tower is held upright by multiple guy lines which are spaced about its periphery. The guy lines permit the tower to pivot a few degrees from vertical about its base in response to surface wind, wave, or current forces, thereby creating inertial forces which counteract the applied forces. The guy lines optionally may include intermediate clump weights and the tower optionally may include buoyancy tanks, both of which aid in restoring the tower to a vertical position. See generally, Finn, L. D., "A New Deep-Water Platform—The Guyed Tower", Journal of Petroleum Technology, April 1978, pp 537–544 (first presented at the 8th Annual Offshore Technology Conference held in Houston, Tex., May 3–6, 1976, OTC Paper No. 2688).

A second type of compliant tower is the "buoyant tower". Basically, a buoyant tower is similar to a guyed tower except that no guy lines are used. The entire restoring force for the tower is provided by large buoyancy tanks attached to the tower, preferably at or near the surface of the body of water. See, for example, the buoyant tower illustrated in U.S. Pat. No. 3,636,716 issued Jan. 25, 1972 to Castellanos.

As described above, the primary response of a compliant tower to environmental forces is oscillation a few degrees from vertical about its base in the manner of an inverted pendulum, with either or both of guy lines and buoyancy tanks providing the restoring force. The guy lines and the water surrounding the tower provide a sufficient amount of damping to quickly damp off the oscillation. The guy lines and buoyancy tanks are typically designed so that the oscillation period of the tower in response to environmental forces is greater than about 20 seconds. Thus, the oscillation period falls outside the range of wave periods likely to contain significant amounts of energy. However, as described below, compliant towers are also subject to the problem of lateral vibration induced by the impact of random surface waves.

A compliant tower may be characterized as a beam having one pinned end, one free end, and a variable restoring force applied at and perpendicular to the free end. When a wave impacts on a compliant tower, it causes both the rigid oscillation previously described and a dynamic flexural vibration. Thus, at the same time, the tower oscillates in the manner of an inverted pendulum and vibrates in the manner of a bowstring. As with rigid, bottom-founded structures, the flexural vibration period of a compliant tower must be less than about 6 or 7 seconds in order to prevent resonance with the waves.

Due to the different types of end restraints (i.e., pinned versus fixed), the flexural vibration period of a compliant tower is less than about one-fourth of the flexural vibration period of a rigid, bottom-founded structure having the same length, weight distribution, and flexural stiffness. Therefore, compliant towers may be used in water depths substantially greater than those for which rigid, bottom-founded structures are practical. However, the design of a compliant tower begins to be dominated by flexural vibration (wave dynamic response) in water depths of about 1,800 to 2,000 feet. Beyond those depths, the steel tonnage and associated costs required to maintain the flexural vibration period of a compliant tower within acceptable limits increase so rapidly that a point is soon reached beyond which compliant towers are no longer economically practical.

Hydrocarbon reservoirs of interest to the offshore petroleum industry have been located in water depths substantially greater than 2,000 feet. Due to the flexural vibration problem described above, neither conventional rigid, bottom-founded structures nor the newer compliant towers may be economically used to produce hydrocarbons from these deep water reservoirs. Accordingly, the need exists for an offshore structure which can be economically used to produce hydrocarbons in water depths greater than 2,000 feet.

The hybrid offshore structure of the present invention satisfies the need outlined above by utilizing a compliant upper section pivotally mounted to the top of a substantially rigid lower section. The lower section extends upwardly from the bottom of the body of water to a pivot point located intermediate the bottom and the surface of the body of water. The location of the pivot point is selected so as to substantially minimize the weight of the structure while maintaining the flexural vibration period of the structure within acceptable limits. Typically, the pivot point would be located above the bottom a distance of between about 10 percent and about 50 percent of the total depth of the body of water. As hereinafter described in greater detail, for a limited range of pivot heights, the weight of steel required to maintain the flexural vibration period of a hybrid structure within acceptable limits may be significantly less than that required for either a rigid, bottom-founded structure of a compliant tower in the same water depth.

Previous offshore structures have utilized a compliant upper section pivotally mounted to the top of a base section. See, for example, the structures disclosed in U.S. Pat. No. 3,522,709 issued Aug. 4, 1970 to Vilain, U.S. Pat. No. 3,553,969 issued Jan. 12, 1971 to Chamberlin et al., U.S. Pat. No. 3,636,716 issued Jan. 25, 1972 to Castellanos, U.S. Pat. No. 3,670,515 issued June 20, 1972 to Lloyd, U.S. Pat. No. 3,735,597 issued May 29, 1973 to Guy, U.S. Pat. No. 4,231,682 issued Nov. 4, 1980 to Tuson, and U.S. Pat. No. 4,273,470 issued June 16, 1981 to Blomsma et al. Generally, the primary purpose of the base section in each of these structures is simply to provide an appropriate foundation for the pivot. None of the patents specifies the height of the base section or attaches any particular significance thereto. Further, none of the patents contains any teachings that use of a lower section having a height of between about 10 percent and about 50 percent of the total depth of the body of water may reduce the weight (and cost) of the structure while maintaining the flexural vibration period of the structure within acceptable limits.

One previous offshore structure which utilizes a base section having a non-negligible height is illustrated in FIG. 5 of U.S. Pat. No. 3,768,268 issued Oct. 30, 1973 to Laffont et al. In Laffont et al. the pivot point is located approximately 300 to 600 feet below the surface of the body of water since below that depth the wave swell has relatively little effect. Thus, in water depths greater than 2,000 feet, the structure disclosed in Laffont et al. would have a pivot height of more than 70 percent of the total water depth. As will be apparent from the following discussion of the present invention, for a structure such as the one illustrated in FIG. 5 of Laffont et al, a pivot height of 70 percent of the water depth would likely result in a structure having a considerably higher flexural vibration period than a compliant tower in the same water depth and having comparable stiffness and weight distribution.

SUMMARY OF THE INVENTION

The hybrid offshore structure of the present invention consists primarily of a substantially rigid lower section extending upwardly from the bottom of the body of water to a pivot point located intermediate the bottom and the surface of the body of water; a compliant upper section extending upwardly from the pivot point; pivot means located proximate the pivot point, said pivot means interposed between and connected to the lower section and the upper section and adapted to permit the upper section to pivot laterally about the pivot point in response to environmental forces; and torsion means for transmitting torsional loads from the upper section to the lower section. The pivot point is located above the bottom of the body of water a distance which will substantially minimize the weight of the structure while maintaining the flexural vibration period of the structure within acceptable limits. Typically, the pivot point would be located above the bottom a distance of between about 10 percent and about 50 percent of the total depth of the body of water. Determination of the optimum location for the pivot point requires consideration of a number of factors including the depth of the body of water, the flexural stiffness and weight distribution of the various components of the structure, and the type of environmental loads likely to be encountered by the structure.

Typically, the substantially rigid lower section would be either a trussed steel frame fixed to the bottom of the body of water by a plurality of piles or a concrete or steel gravity base. The trussed steel frame would typically be frustum-shaped. However, if desired, other shapes may also be used. The concrete or steel gravity base optionally may include a trussed steel frame to raise the pivot point to the desired location.

The compliant upper section typically would be a trussed steel frame of generally uniform cross-section. In the preferred embodiment, an array of guy lines circumscribing the upper section are used to provide the necessary restoring force to return the upper section to vertical after it has pivoted laterally in response to an environmental load. Preferably, such guy lines are attached to the upper section at or near the surface of the body of water. Such guy lines optionally may include intermediate clump weights. Further, one or more buoyancy tanks may be attached to the upper section at or near the surface of the body of water to supplement the guy lines. In an alternate embodiment, no guy lines are used. The entire restoring force is provided by one or more large buoyancy tanks attached to the upper section at or near the surface of the body of water.

Any suitable pivot means and torsion means may be used. The pivot means must be capable of transmitting vertical loads from the upper section to the lower section while permitting the upper section to pivot laterally a few degrees from vertical in response to environmental loads. One pivot means which may be used in connection with the present invention is a ball joint. The torsion means must be capable of transmitting torsional loads from the upper section to the lower section while permitting the upper section to pivot laterally in response to environmental loads. One torsion means suitable for use in connection with the present invention comprises one or more torsion piles attached to the upper section and passing through corresponding pile guides attached to the lower section. The torsion piles are permitted to slide vertically upwardly or downwardly in their corresponding pile guides as the upper section pivots. However, torsional loads are transmitted by the torsion piles to their corresponding pile guides and hence to the lower section. Optionally, the pivot means and torsion means may be combined in a single unit by use of a universal joint, as more fully described below.

In an alternate embodiment, the pivot means comprises one or more main piles located in a closely spaced cluster within the structure. Preferably, the cluster of main piles is located at or near and substantially parallel to the vertical centerline of the structure. However, if desired, the cluster of main piles may be laterally offset from the vertical centerline of the structure. Typically, the main piles are attached to the upper section only at their upper ends and extend downwardly through a plurality of main pile guides located along the length of the upper section. One or more main pile sleeves are rigidly attached to the lower section so as to be vertically aligned with the main piles. The main piles extend into and are attached to the corresponding main pile sleeves. The main piles function essentially as long columnar springs. Vertical loads are transmitted by the main piles from the upper section to the main pile sleeves and hence to the lower section. The main piles elastically deflect to permit the upper section to pivot laterally in response to environmental loads.

BRIEF DESCRIPTION OF THE DRAWINGS

The actual operation and advantages of the present invention will be better understood by referring to the following detailed description and the attached drawings in which:

FIG. 1 is an elevational view illustrating the primary features of one embodiment of the present invention;

FIG. 2 is a partial elevational view illustrating a second embodiment of the present invention which utilizes a gravity base;

FIG. 3 is a partial elevational view illustrating another embodiment of the present invention which utilizes a universal joint as the pivot means and the torsion means;

FIG. 4 is a partial elevational view illustrating another embodiment of the present invention which utilizes a main pile cluster as the pivot means;

Figure 5:
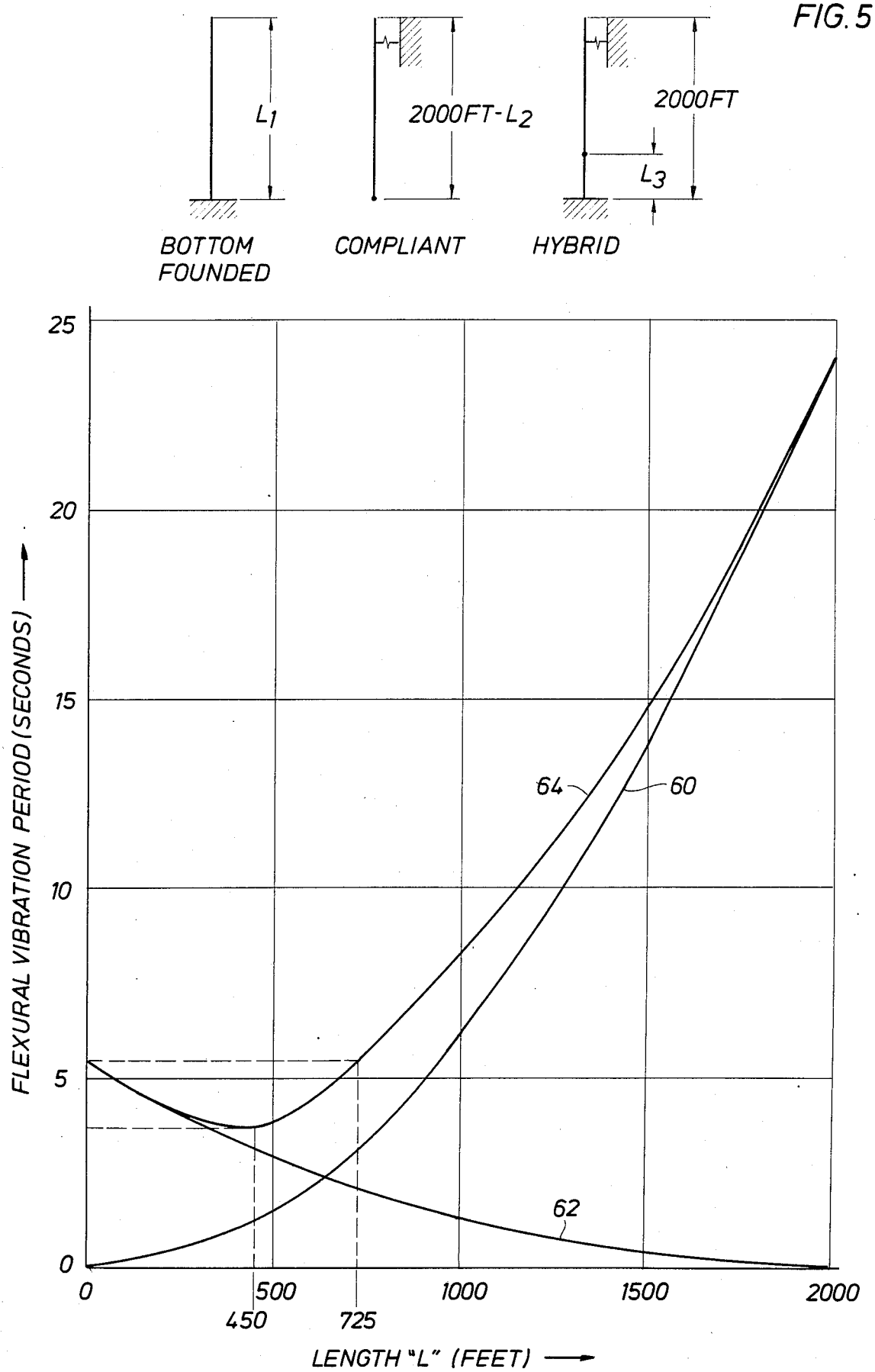
FIG. 5 is a plot of flexural vibration period versus a specified length factor for three hypothetical offshore structures—a bottom-founded structure, a compliant structure, and a hybrid structure according to the present invention.

While the invention will be described in connection with the preferred embodiment, it will be understood that the invention is not limited to that embodiment. On the contrary, it is intended to cover all alternatives, modifications, and equivalents, which may be included within the spirit and scope of the invention, as defined by the appended claims.

DETAILED DESCRIPTION OF THE PREFERRED EMBODIMENT

Referring now to FIG. 1, a hybrid offshore structure according to the present invention is located in a body of water 12 having a surface 14 and a bottom 16. Hybrid offshore structure 10 consists generally of a substantially rigid lower section 18, a compliant upper section 20, pivot means 22, and torsion means 24. A deck 26 for conducting petroleum drilling and producing operations is located on the upper end of compliant upper section 20.

Substantially rigid lower section 18 consists of a trussed steel frame 38 which is fixed to the bottom 16 by a plurality of piles 28 as is well known in the art. Typically, frame 38 would be frustum-shaped, as illustrated in FIG. 1. However, if desired, other shapes may also be used. For example, a constant-width lower section may be used instead of the frustum-shaped lower section. A plurality of pile sleeves 29 are attached to frame 38. Piles 28 are grouted or otherwise fixed within pile sleeves 29 and extend a predetermined distance into bottom 16.

Lower section 18 extends upwardly from the bottom 16 to a pivot point located generally within structure 10 intermediate the bottom 16 and the surface 14 of body of water 12. Pivot means 22 is located proximate this pivot point. Preferably, the pivot point is located on the vertical centerline of structure 10. However, if desired, the pivot point may be laterally offset from the vertical centerline of structure 10 as illustrated in FIG. 2 where the pivot point has been laterally offset a distance of "x" from the vertical centerline. The height "h" of lower section 18 (distance from bottom 16 to pivot point) is generally between about 10 percent and about 50 percent of the total depth "d" of body of water 12. Height "h" of lower section 18 is selected so as to substantially minimize the weight of hybrid offshore structure 10 while maintaining the flexural vibration period of structure 10 within acceptable limits, as more fully described below.

As illustrated in FIG. 1, compliant upper section 20 is a trussed steel frame 21 of generally uniform cross-section. Typically, the cross-section would be square in shape, however, other cross-sections may also be used. Upper section 20 extends upwardly from the pivot point to deck 26 located above the surface 14 of body of water 12. A drilling derrick 27 and other equipment (not shown) for conducting petroleum drilling and producing operations may be located on deck 26. Upper section 20 is allowed to pivot laterally about the pivot point in response to environmental loads by pivot means 22, as will be more fully described below. The maximum lateral deflection of upper section 20 is no more than a few degrees from vertical, even given the most severe environmental conditions.

In the preferred embodiment, upper section 20 is essentially a guyed tower. An array of guy lines 32 circumscribing upper section 20 ar attached to frame 21 at or near its upper end to provide the necessary restoring force to return upper section 20 to vertical after it has pivoted laterally in response to an environmental load. Optionally, such guy lines may include intermediate, articulated clump weights (not shown) to aid in damping off oscillations of upper section 20. The operation of such clump weights is described in U.S. Pat. No. 3,903,705 issued Sept. 9, 1975 to Beck, et al. Additionally, one or more buoyancy tanks 30 may be attached to frame 21 at or near its upper end. Buoyancy tanks 30 offset at least a portion of the weight of upper section 20 and deck 26 and provide additional restoring force to assist in returning upper section 20 to vertical after it has pivoted laterally in response to an environmental load. Buoyancy tanks 30 may optionally be attached either to the interior or the exterior of frame 21. In an alternate embodiment, buoyancy tanks 30 are used to completely replace guy lines 32. In this embodiment, upper section 20 is essentially a buoyant tower. The entire restoring force is provided by buoyancy tanks 30.

Pivot means 22 is attached to upper section 20 and lower section 18 at or near the pivot point and serves two primary functions. First, pivot means 22 permits upper section 20 to pivot laterally in response to environmental loads. Second, pivot means 22 transmits vertical loads from upper section 20 to lower section 18. Pivot means 22 may also be used to transmit horizontal shear loads from upper section 20 to lower section 18. Any suitable type of pivot such as, for example, a ball joint may be used for pivot means 22. Two other suitable pivots are illustrated in FIGS. 3 and 4 and will be further described below.

Compliant upper section 20 is subject to substantial torsional loads resulting from wind, waves, and ocean currents impinging on drilling derrick 27 and on the well conductors and other objects (not shown) which are asymmetrically located on the structure. These torsional loads must be transmitted to and resisted by the foundation of the structure in order to prevent damage to the structure. Torsion means 24 transmits torsional loads from upper section 20 to lower section 18 and hence to bottom 16. Any suitable torsion means may be used. As illustrated in FIGS. 1, 2, and 4, torsion means 24 consists of at least one torsion pile 34 and a corresponding pile guide 36. Typically, torsion means 24 would consist of a plurality of torsion piles 34 and corresponding pile guides 36 spaced about the periphery of structure 10. As illustrated in FIGS. 1 and 4, each of the torsion piles 34 is rigidly attached at its upper end to the lower end of frame 21. Each of the pile guides 36 is rigidly attached to the upper end of frame 38 so as to mate with the corresponding torsion pile 34. As upper section 20 pivots laterally in response to an environmental load, torsion piles 34 slide vertically upwardly or downwardly in their corresponding pile guides 36. Thus, torsion means 24 does not inhibit the pivoting movement of the structure. However, torsional loads on upper section 20 are transmitted by the torsion piles 34 to their respective pile guides 36 and, ultimately, by piles 28 to bottom 16. Alternatively, torsion means 24 may be inverted (see FIG. 2) with the torsion piles 34 rigidly attached to frame **38*a* and extending upwardly through corresponding pile guides 36 attached to frame 21. Torsion means 24 may also be used to transmit horizontal shear loads from upper section 20 to lower section 18**. Another suitable torsion means is disclosed in U.S. Pat. No. 3,735,597 issued May 29, 1973 to Guy.

FIG. 2 illustrates an alternate embodiment of the present invention in which the substantially rigid lower section **18*a* comprises a trussed steel frame 38*a* rigidly attached to a concrete or steel gravity base 40. The height of frame 38*a* may be as small as only a few feet or as large as several hundred feet. Alternatively, gravity base 40 may extend the full distance "h" from bottom 16 to the pivot point, thereby eliminating the need for frame 38*a*. Typically, gravity base 40 would consist of a plurality of individual hollow cells 42 arranged in a honeycomb configuration. These cells 42 are typically ballasted with sea water or with a heavier material such as sand or gravel to hold the structure 10 rigidly on bottom 16. Alternatively, cells 42 may be used for temporary storage of oil produced from the subsea wells (not shown). Prior to installation of the structure 10, the cells 42 are evacuated thereby providing sufficient bouyancy to permit the lower section 18*a* to be floated to the proper location. Once the structure 10 is on location, cells 42 are ballasted causing the lower section 18*a* to sink to bottom 16. Further ballasting provides sufficient weight to keep structure 10 rigidly in place throughout the most severe environmental conditions. Cells 42 may be evacuated to refloat lower section 18*a*. Due to the difficulty of installing piles 28 (see FIG. 1) in very deep waters, the use of a gravity base 40 such as illustrated in FIG. 2 may reduce the time and cost required to install hybrid offshore structure 10**.

FIG. 3 illustrates another embodiment of the invention in which pivot means 22 and torsion means 24 are replaced by universal joint 42. Universal joint 42 consists primarily of two downwardly extending pillow blocks 44 attached to frame 21, two upwardly extending pillow blocks 46 (one shown) attached to frame 38 (or **38*a*, see FIG. 2), and cross piece 48, together with associated bearings and other hardware (not shown). Pillow blocks 44 are attached to opposite sides of the bottom of frame 21 in such a manner that the axis "a" through their bores passes through and is perpendicular to the vertical centerline of structure 10. Pillow blocks 46 are attached to opposite sides of the top of frame 38 (or 38*a*) in such a manner that the axis (not shown) through their bores passes through and is perpendicular to both axis "a" and the vertical centerline of structure 10. As is well known in the art, cross piece 48 consists of two mutually perpendicular shafts joined at the center and passing through the bores of pillow blocks 44 and pillow blocks 46. Universal joint 42 permits upper section 20 to pivot laterally in response to environmental loads. However, universal joint 42 is capable of transmitting torsional, horizontal, and vertical loads from upper section 20 to lower section 18 (or 18*a*) and hence to bottom 16. Thus, universal joint 42 is capable of performing the functions of both pivot means 22 and torsion means 24**.

Another embodiment of the invention is illustrated in FIG. 4. In this embodiment, the pivot means consists of one or more main piles 50 (two shown). Main piles 50 may be either single tubular pile elements, as illustrated in FIG. 4, or concentric "nested" pile elements, as disclosed in U.S. Pat. No. 4,378,179 issued Mar. 29, 1983 to Hasle. Preferably, each main pile 50 is attached to frame 21 only at its upper end which is located at or near deck 26. However, if concentric "nested" pile elements are used, the connection to frame 21 may be at either the upper end or the lower end of the outer pile jacket (depending on the number of nested elements forming each main pile 50), as more fully described in U.S. Pat. No. 4,378,179. Main piles 50 extend downwardly through a series of main pile guides 52 spaced along the length of frame 21. Main pile guides 52 are rigidly attached to braces 54 which form part of frame 21. One or more main pile sleeves 56 are rigidly attached to braces 58 which form part of frame 38 (or 38*a*). Main pile sleeves 56 are located so as to be vertically aligned, respectively, with each of the main piles 50. The lower ends of main piles 50 extend into main pile sleeves 56 and are grouted or otherwise fixed therein.

In the embodiment shown in FIG. 4, main piles 50 function essentially as long columnar springs. Vertical loads are transmitted by main piles 50 to their corresponding main pile sleeves 56 and hence to frame 38 (or 38*a*). Main piles 50 deform elastically to permit upper section 20 to pivot laterally in response to environmental loads. This elastic deformation of main piles 50 occurs over a finite length of each main pile 50 from the corresponding main pile sleeve 56 to at least the lowest main pile guide 52. Thus, in this embodiment the pivot means is not located precisely at the pivot point. Nevertheless, upper section 20 still pivots laterally about the pivot point.

Ideally, only one main pile 50 would be used. However, as a practical matter and to provide desirable redundancy, it is likely that a cluster of main piles 50 would actually be used. Such a cluster might include as many as eight or more main piles 50. Preferably, the cluster of main piles 50 should be located as near as possible to the vertical centerline of structure 10. However, if desired, the entire cluster may be laterally offset from the vertical centerline. As upper section 20 pivots laterally, some of the main piles 50 will be placed in tension while others will be placed in compression. However, since main piles 50 are quite long, the resulting tensile or compressive forces should not be excessive. Use of a cluster of main piles 50 may also eliminate the need for torsion means 24 since the cluster itself is capable of transmitting torsional and horizontal shear loads. However, if desired, a torsion means 24 similar to that described above may be used to transmit torsional and horizontal shear loads from upper section 20 to lower section 18 (or 18*a*). Other suitable torsion means may also be used.

Location of Pivot Point

A number of factors must be evaluated in order to determine the optimum pivot point location for a given hybrid structure. These factors include, but are not limited to, the depth of the body of water, the dimensions and respective flexural stiffnesses of the upper section and the lower section, the weight distribution along the length of the upper section and the lower section, and the frequency and magnitude of the environmental loads likely to be encountered by the structure. In theory, the optimum pivot point location for a given hybrid structure will be the location which results in the lowest flexural vibration period for the structure. However, in practice, the optimum location for the pivot point will likely be the location which results in the lowest total weight for the hybrid structure while maintaining the flexural vibration period within acceptable limits.

FIG. 5 is a plot of flexural vibration period versus a specified length factor "L" for three hypothetical offshore structures—a bottom-founded structure, a compliant tower, and a hybrid structure. Each of the structures was assumed to have a stiffness to mass ratio (I/m) of 20 where "I" is stiffness ($ft^4$) and "m" is mass per unit length (slugs/ft). As shown at the top of FIG. 5, the bottom-founded structure was modeled as a beam of length "$L_1$" having one end fixed and the other end free. For reasons which will become apparent, the compliant tower was modeled as a beam of length "2,000 ft.—$L_2$" having one end pinned, one end free, and a variable restoring force applied at and perpendicular to the free end. It should be noted that the variable restoring force aids in returning the compliant tower to vertical after it has pivoted laterally in response to an environmental load, but has no effect on the flexural vibration period of the structure. Finally, the hybrid structure was modeled as a compliant tower of length "2,000 ft—$L_3$" pinned to the upper end of a bottom-founded structure of length "$L_3$". Thus, the model for the hybrid tower is essentially a combination of the models for the bottom-founded structure and the compliant tower.

Conventional dynamic analysis techniques were used to determine the flexural vibration period curves for the bottom-founded structure (curve 60) and the compliant tower (curve 62). The flexural vibration period curve for the hybrid structure (curve 64) was determined through the use of a computer program. The computer program is based on a lumped mass model of the structure in which a series of nodes are distributed along the length of the structure. The mass weight adjacent to each node is lumped at the node thereby forming a diagonal mass matrix. The stiffness of the structure is modeled by an equivalent vertical beam having the same moment of inertia properties as the structure. A stiffness matrix for the system is formed using standard techniques. The flexural vibration period of the structure is obtained by performing an eigenvalue analysis of the dynamical matrix formed from the mass and stiffness matrices. The particulars of the computer program will not be further described herein. The analysis techniques employed in the computer program are set forth in Finn, L. D., "A New Deep-Water Platform—The Guyed Tower", Journal of Petroleum Technology, April 1978, pp. 537–544. Writing a computer program based on the analysis techniques set forth in this reference and for duplicating the results presented herein is well known to those skilled in the art.

Referring again to FIG. 5, the depth of water for the hybrid structure was assumed to be 2,000 feet and the pivot point was located a distance of $L_3$ above the bottom of the body of water. Therefore, if $L_3$ equals 0, the flexural vibration period would be equal to that of a 2,000 foot compliant tower (i.e., L=0 on curve 62). Similarly, if $L_3$ equals 2,000 feet, the flexural vibration period of the hybrid structure would be equal to that of a 2,000 foot bottom-founded structure (i.e., L=2,000 on curve 60).

Curve 62 indicates that the flexural vibration period of a 2,000 foot compliant tower ($L_2$=0) having a uniform cross-section and a stiffness to mass ratio of 20 is approximately 5½ seconds. Curve 64 indicates that for any $L_3$ between approximately 0 and 725 feet (36.25% of the water depth), the flexural vibration period for a 2,000 foot hybrid structure having a uniform cross-section and a stiffness to mass ratio of 20 is less than the flexural vibration period of a 2,000 foot compliant tower. The optimum pivot location for this example is at $L_3=450$ feet (22.5% of the water depth) where the flexural vibration period is approximately 4 seconds. Thus, it can be seen that over a relatively broad range of pivot heights the wave dynamic response of a hybrid structure is superior to that of a corresponding compliant tower. It should also be noted that increasing the stiffness of the lower section (i.e., by using a frustum-shaped lower section as illustrated in FIG. 1) may further reduce the flexural vibration period of the hybrid structure and further broaden the range of acceptable pivot heights.

As indicated above, in practice, the optimum pivot location will be the one which results in the lowest total weight for the hybrid structure while maintaining the flexural vibration period within acceptable limits. Accordingly, a study was conducted to determine the effect of variations in pivot height on the weight of a hybrid structure. The results of the study indicate that in deep water the total steel weight required for a hybrid structure can be as much as 30 to 40 percent less than that required for a compliant tower in the same water depth.

Figure 6:
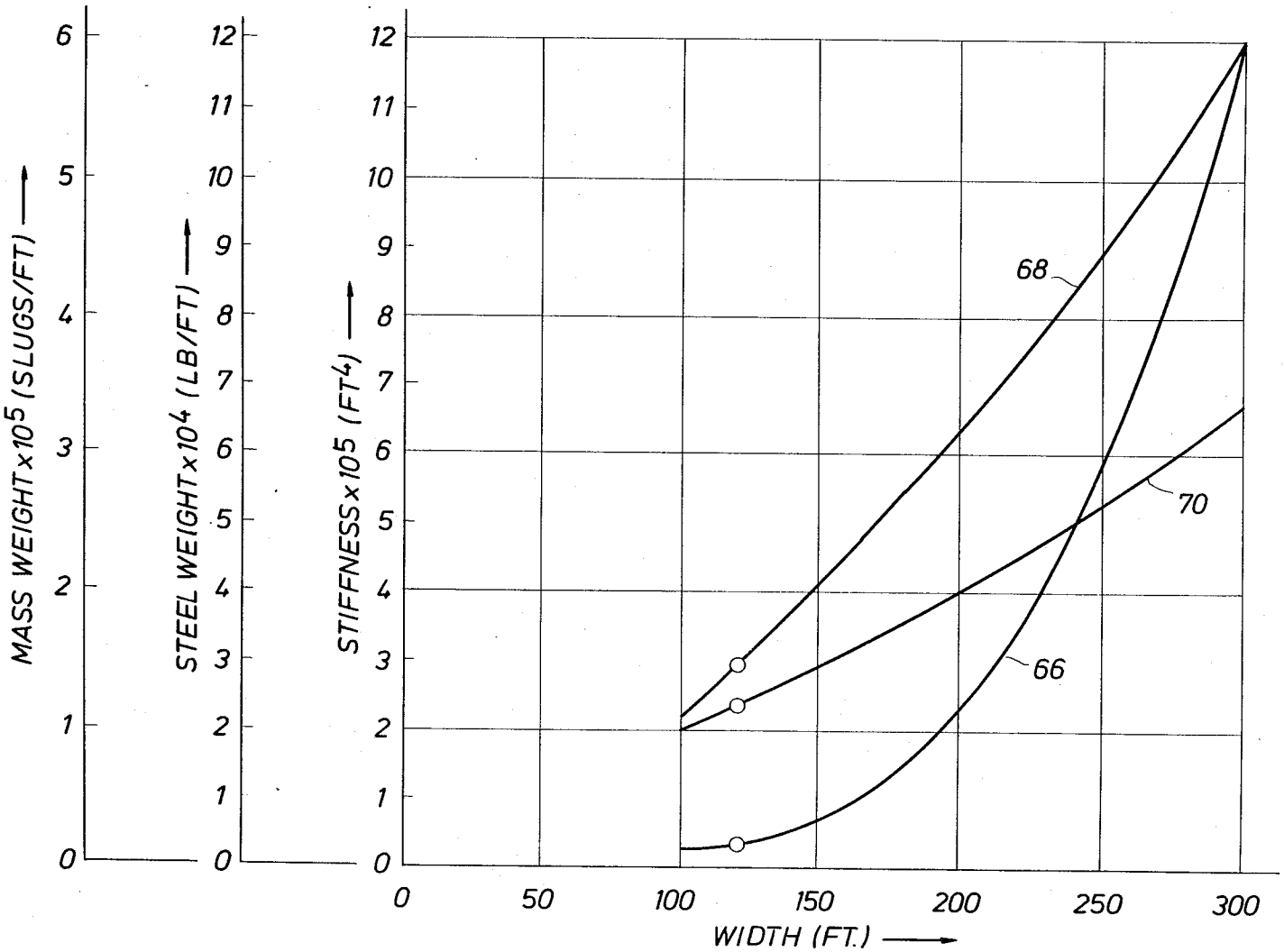
FIG. 6 is a plot of certain data used to conduct a study of the effect of variations in pivot location on the weight of steel required for a hybrid structure.

Three types of data, the structure stiffness, the steel weight of the structure per unit length (i.e., per foot of height), and the mass weight of the structure per unit length, each as a function of the structure width, were required for the study. A square cross-section was assumed. The source of the data was the actual values for an existing guyed tower having a 120 foot by 120 foot cross-section which were then scaled to other widths by assuming that the structural members were scaled geometrically with width. The data used for the study is plotted in FIG. 6. Curve 66 is a plot of stiffness versus width. Curve 68 is a plot of steel weight per unit length versus width. Curve 70 is a plot of mass weight per unit length versus width. For any given width, the stiffness, weight per unit length, and mass per unit length may be determined by referring to the appropriate ordinate. The circled points on each of the curves at a width of 120 feet are the values for the existing guyed tower from which the remainder of the values were scaled.

The water depth for the study was assumed to be 2,600 feet. Two different limiting flexural vibration periods, 5 seconds and 7 seconds, were investigated. Further, both constant-width and frustum-shaped lower sections were studied. In all cases, the constant-width lower section was assumed to be the same width as the compliant upper section. The lower end of the frustum-shaped lower section was assumed to be 300 feet square and the upper end was assumed to be the same width as the compliant upper section.

A number of different pivot heights from 0 to 1,500 feet above the bottom of the body of water were investigated. For each pivot height, the minimum width that maintains the hybrid structure's flexural vibration period below the chosen limiting period was determined using the structural modeling techniques described above. Once the minimum width for each pivot height was found, the steel weight for that width was determined from curve 68 on FIG. 6. The pivot height and the corresponding steel weight were then normalized in terms of the zero-pivot-height values and plotted on FIG. 7. The zero-pivot-height values would be those of a 2,600 foot compliant tower having a width such that the flexural vibration period of the compliant tower is less than or equal to the chosen limiting period. Curve 72 represents the results for a hybrid structure having a constant-width lower section and a limiting flexural vibration period of 5 seconds. As indicated by point A on curve 72, the optimum pivot height for this structure is at approximately 24 percent of the water depth (625 feet above the bottom) and at that point the steel weight required for the structure is approximately 66 percent of that required for a compliant tower in the same water depth. Curve 74 represents the results for a hybrid structure having a constant-width lower section and a limiting flexural vibration period of 7 seconds. As indicated by point B on curve 74, the optimum pivot location for this structure is at approximately 22½ percent of the water depth (585 feet above the bottom) and the steel weight required is approximately 70 percent of the zero-pivot-height weight. Curve 76 (shown dashed for clarity) represents the results for a hybrid structure having a frustum-shaped lower section and a limiting flexural vibration period of 5 seconds. As indicated by point C on curve 76, the optimum pivot location for this structure is at approximately 33 percent of the water depth (860 feet above the bottom) andthe steel weight required is approximately 62 percent of the zero-pivot-height weight.

Figure 7:
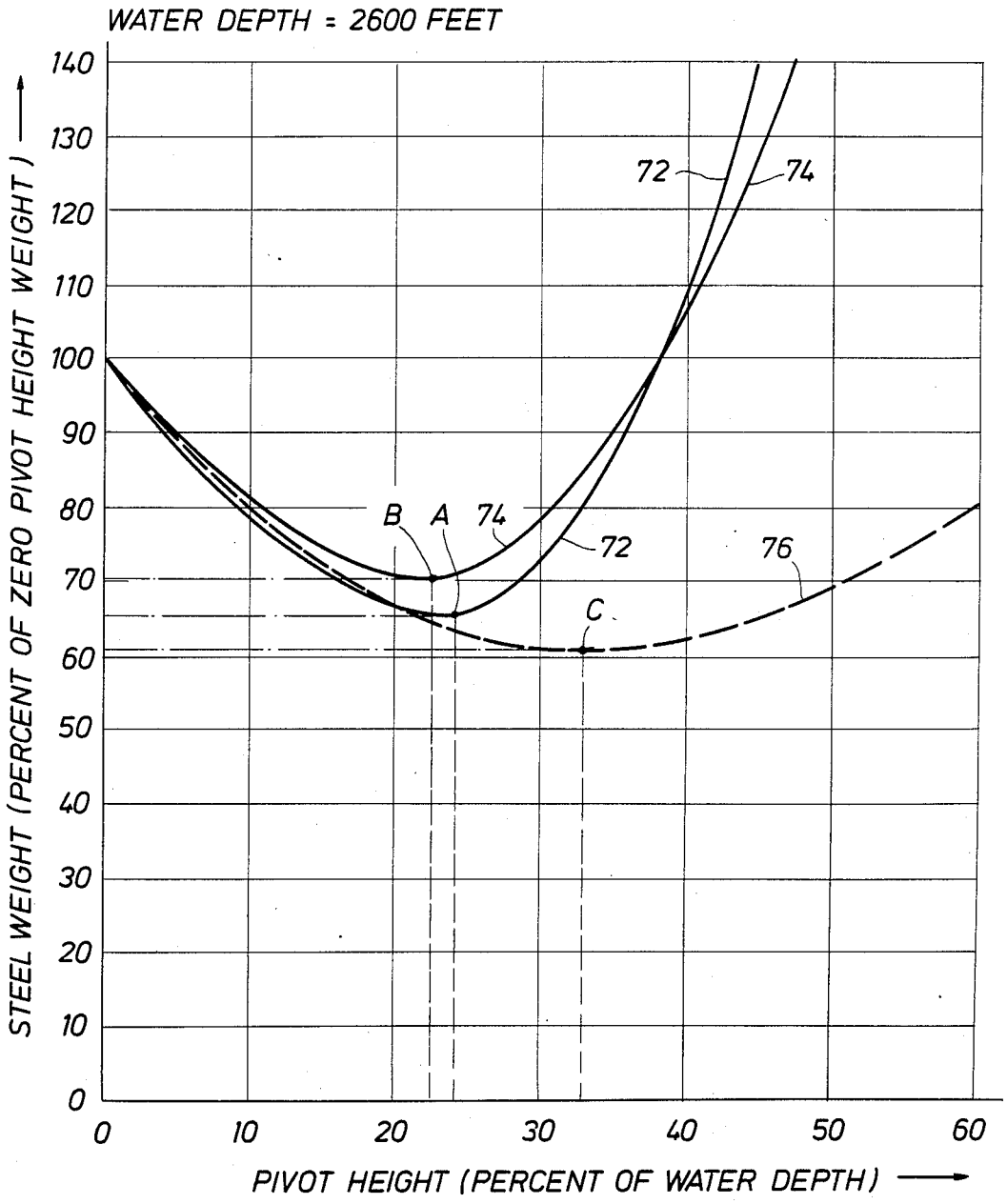
FIG. 7 is a plot of steel weight versus pivot height, both normalized in terms of the zero-pivot-height values, for three hypothetical hybrid structure designs.

FIG. 7 indicates that in some cases the pivot point may be located above the bottom a distance of as much as 50 percent or more of the total water depth and still result in a reduction in the amount of steel required for the hybrid structure. However, it is likely that for most, if not all, hybrid structures, the optimum location for the pivot point will be at a height above the bottom of between about 10 percent and about 50 percent of the total water depth.

The foregoing discussion of the method by which the optimum pivot point for a hybrid structure might be determined has been set forth for purposes of illustration and not by way of limitation. Other factors not discussed above may influence the selection of a pivot location for a given hybrid structure. Further, the substantial reduction in weight (and hence in cost) indicated in FIG. 7 may be reduced by other factors.

As described above, the hybrid offshore structure extends the technical and economic feasibility of offshore structures to very deep waters. Additionally, the hybrid structure provides several other advantages. The use of a concrete or steel gravity base (FIG. 2) could reduce the cost and time necessary to install the structure and would provide a large oil storage capacity. The wider foundation dimensions of the frustum-shaped lower section (as compared to conventional compliant towers) would provide greater torsional stiffness in the foundation, reducing the overall torsional response of the structure. The fixed base utilized in the hybrid structure eliminates the need for flexible underwater pipeline and riser connections which are normally required for a compliant tower. Other advantages of the hybrid structure will be obvious to those skilled in the art.

The present invention and the best mode contemplated for practicing the invention have been described. It should be understood that the invention is not to be unduly limited to the foregoing which has been set forth for illustrative purposes. Various modifications and alterations of the invention will be apparent to those skilled in the art without departing from the true scope of the invention, as defined in the following claims.

What we claim is:

1. An articulated offshore structure for use in a body of water, said structure comprising:

a substantially rigid lower section, said lower section extending upwardly from the bottom of said body of water to a pivot point located intermediate the bottom and the surface of said body of water;

a compliant upper section extending upwardly from said pivot point to a position at or above the surface of said body of water;

pivot means located proximate said pivot point, said pivot means interposed between and connected to said lower section and said upper section and adapted to permit said upper section to pivot laterally relative to said lower section;

torsion means connected to said upper section and said lower section, said torsion means adapted to transmit torsional loads from said upper section to said lower section;

said pivot means being positioned above the bottom of said body of water a distance of between about 10 percent and about 50 percent of the total depth of said body of water so as to substantially minimize the weight of said structure while maintaining the flexural vibration period of said structure at or below a preselected maximum flexural vibration period.

2. The articulated offshore structure of claim 1 wherein said preselected maximum flexural vibration period is equal to or less than about 7 seconds.

3. The articulated offshore structure of claim 1 wherein said substantially rigid lower section comprises:

a trussed frame;

a plurality of pile sleeves fixedly attached to said trussed frame; and a plurality of piles passing through and attached to said pile sleeves and extending into the bottom of said body of water.

4. The articulated offshore structure of claim 3 wherein said trussed frame is generally frustum-shaped.

5. The articulated offshore structure of claim 3 wherein said trussed frame has a substantially constant width.

6. The articulated offshore structure of claim 1 wherein said substantially rigid lower section comprises a gravity base.

7. The articulated offshore structure of claim 6 wherein said gravity base comprises a plurality of individual hollow cells.

8. The articulated offshore structure of claim 7 wherein said cells are adapted for use as an oil storage facility.

9. The articulated offshore structure of claim 1 wherein said substantially rigid lower section comprises:

a gravity base having an upper surface located below said pivot point; and a trussed frame extending upwardly from said upper surface to said pivot point.

10. The articulated offshore structure claim 1 wherein said pivot means comprises a ball joint.

11. The articulated offshore structure of claim 10 wherein said guyed tower includes one or more buoyancy tanks attached thereto.

12. The articulated offshore structure of claim 1 wherein said pivot means comprises:

at least one main pile sleeve attached to said substantially rigid lower section; and at least one substantially vertical main pile element attached to said compliant upper section and having a lower end which extends into and is attached to said main pile sleeve.

13. The articulated offshore structure of claim 12 wherein the upper end of said main pile element is located at or near the surface of said body of water, said main pile element being attached to said compliant upper section only at said upper end, and wherein said pivot means further comprises a plurality of main pile guides attached to and spaced along said compliant upper section such that said main pile element passes through and is guided by said plurality of main pile guides.

14. The articulated offshore structure of claim 1 wherein said compliant upper section is a buoyant tower.

15. The articulated offshore structure of claim 1 wherein said compliant upper section is a guyed tower.

16. The articulated offshore structure of claim 1 wherein said pivot means comprises:

a plurality of main pile sleeves attached to said substantially rigid lower section, said plurality of main pile sleeves being grouped in a closely spaced cluster;

a plurality of main pile elements vertically aligned, respectively, with said main pile sleeves, each of said main pile elements being attached to said compliant upper section and extending into and attached to the corresponding main pile sleeve; and a vertically aligned plurality of main pile guides corresponding to each of said main pile elements, said plurality of main pile guides being spaced along and attached to said compliant upper section such that said corresponding main pile element passes through and is guided by said plurality of main pile guides.

17. The articulated offshore structure of claim 1 wherein said torsion means comprises:

at least one pile guide attached to said substantially rigid lower section; and at least one torsion pile having an upper end attached to said compliant upper section and a lower end which passes through and is guided by said pile guide.

18. The articulated offshore structure of claim 1 wherein said torsion means comprises:

at least one pile guide attached to said compliant upper section; and at least one torsion pile having a lower end attached to said substantially rigid lower section and an upper end which passes through and is guided by said pile guide.

19. The articulated offshore structure of claim 1 wherein said pivot means and said torsion means comprise a universal joint.

* * * * *